US012262769B2

(12) United States Patent
Lynn

(10) Patent No.: US 12,262,769 B2
(45) **Date of Patent: *Apr. 1, 2025**

(54) INDEPENDENT DOUBLE-SIDED MATERIAL FASTENER

(71) Applicant: All Time Supply LLC, Southampton, NY (US)

(72) Inventor: Nicholas Mizrahi Lynn, New York, NY (US)

(73) Assignee: All Time Supply LLC, Southampton, NY (US)

( * ) Notice: Subject to any disclaimer, the term of this patent is extended or adjusted under 35 U.S.C. 154(b) by 109 days.

This patent is subject to a terminal disclaimer.

(21) Appl. No.: 18/161,194

(22) Filed: Jan. 30, 2023

(65) Prior Publication Data

US 2023/0172296 A1 Jun. 8, 2023

Related U.S. Application Data

(63) Continuation of application No. 17/600,746, filed as application No. PCT/US2020/026181 on Apr. 1, 2020, now Pat. No. 11,564,433.

(Continued)

(51) Int. Cl.

| | |
|---|---|
| ***A41F 9/02*** | (2006.01) |
| ***A41D 1/089*** | (2018.01) |
| ***A41D 7/00*** | (2006.01) |

(52) U.S. Cl.

CPC ..... *A41F 9/025* (2013.01); *A41D 1/089* (2018.01); *A41D 7/005* (2013.01); *A41D 2300/32* (2013.01)

(58) Field of Classification Search

CPC ..... A41F 9/025; A41F 9/00; A41D 1/089; A41D 7/005; A41D 2300/32

See application file for complete search history.

(56) References Cited

U.S. PATENT DOCUMENTS

| | | | |
|---|---|---|---|
| 849,060 | A | 4/1907 | Friedbaum |
| 1,018,009 | A | 2/1912 | Schremp |

(Continued)

FOREIGN PATENT DOCUMENTS

| | | | |
|---|---|---|---|
| DE | 202013008352 | U1 | 12/2013 |
| FR | 2830726 | A1 | 4/2003 |

OTHER PUBLICATIONS

Communication (International Search Report) issued by the International Searching Authority in International Application No. PCT/US2020/026181 dated Jul. 23, 2020, 3 pages total.

(Continued)

*Primary Examiner* — Khaled Annis

(74) *Attorney, Agent, or Firm* — Troutman Pepper Hamilton Sanders LLP

(57) ABSTRACT

A fastener connecting two materials, with a first material having a strap aperture. A second material had an edge, and a strap extending past the edge toward the first material. The strap has a top and bottom side affixing mechanisms. The second material has a second material affixing mechanism and a hinged material panel disposed proximate the second material affixing mechanism comprising a hinged panel affixing mechanism. The fastener has a fastened where the strap passes through the strap aperture, reverse back upon itself and passes the edge. The bottom side affixing mechanism is affixed to the second material affixing mechanism; and the top side affixing mechanism is affixed to the hinged panel affixing mechanism. The strap is interposed between both the second material affixing mechanism and the hinged panel affixing mechanism resulting in a secure, protected independent double-sided material fastener which can be engaged and disengaged repeatedly and adjusted.

17 Claims, 11 Drawing Sheets

Related U.S. Application Data

(60) Provisional application No. 62/828,016, filed on Apr. 2, 2019.

(56) References Cited

U.S. PATENT DOCUMENTS

| | | | | |
|---|---|---|---|---|
| 2,544,333 | A | 3/1951 | Lembo | |
| 2,583,992 | A | 1/1952 | Bouteloup | |
| 4,126,951 | A | 11/1978 | Antonious | |
| 4,273,130 | A | 6/1981 | Simpson | |
| 5,003,640 | A | 4/1991 | Pizzacar | |
| 5,157,790 | A | 10/1992 | Aleridge | |
| 5,538,502 | A | 7/1996 | Johnstone | |
| 5,598,586 | A | 2/1997 | Munjone | |
| 5,769,290 | A | 6/1998 | Pestana | |
| 5,799,335 | A | 9/1998 | Ethier | |
| 5,867,839 | A | 2/1999 | Lawlor | |
| D408,116 | S | 4/1999 | Gale | |
| 6,123,601 | A | 9/2000 | Hildebrandt | |
| 6,131,249 | A | 10/2000 | Suenaga | |
| 6,319,091 | B1 | 11/2001 | Kilbride et al. | |
| 6,374,414 | B1 | 4/2002 | Collier | |
| 6,715,155 | B2 * | 4/2004 | Duflos | A41F 9/025 2/237 |
| 6,880,175 | B2 | 4/2005 | Tajima et al. | |
| 7,008,292 | B2 | 3/2006 | Cosentino et al. | |
| 7,703,151 | B2 | 4/2010 | Blauer et al. | |
| 7,967,765 | B2 | 6/2011 | Nathanson | |
| 8,429,762 | B2 * | 4/2013 | Weisman | A41F 9/00 2/237 |
| D692,641 | S | 11/2013 | Lai | |
| 9,101,789 | B2 | 8/2015 | Schirenebeck et al. | |
| 9,700,083 | B2 | 7/2017 | DeCotiis | |
| 10,010,120 | B1 | 7/2018 | Lowe | |
| 10,264,838 | B2 | 4/2019 | Quiroz et al. | |
| 10,561,520 | B2 | 2/2020 | Klutts | |
| 10,856,596 | B1 | 12/2020 | Banas | |
| 10,925,337 | B2 | 2/2021 | McCarty et al. | |
| 11,498,490 | B1 * | 11/2022 | Dexter | B60R 11/00 |
| 2003/0014807 | A1 | 1/2003 | Duflos | |
| 2003/0182715 | A1 | 10/2003 | Wallace | |
| 2004/0111784 | A1 | 6/2004 | Henricksen | |
| 2005/0015853 | A1 | 1/2005 | Collier | |
| 2005/0102802 | A1 | 5/2005 | Sitbon et al. | |
| 2005/0177920 | A1 | 8/2005 | Wilkinson | |
| 2007/0049141 | A1 | 3/2007 | Staver et al. | |
| 2007/0050890 | A1 | 3/2007 | Purnell | |
| 2007/0261150 | A1 | 11/2007 | Oomae | |
| 2008/0092272 | A1 | 4/2008 | Vainio et al. | |
| 2010/0319167 | A1 | 12/2010 | Nirmel | |
| 2011/0101061 | A1 | 5/2011 | Schierenbeck et al. | |
| 2011/0219522 | A1 | 9/2011 | Petitt | |
| 2012/0246791 | A1 | 10/2012 | Weisman | |
| 2013/0031698 | A1 | 2/2013 | Valles | |
| 2013/0065483 | A1 | 3/2013 | Liguori | |
| 2013/0298311 | A1 | 11/2013 | Gerenda et al. | |
| 2014/0047619 | A1 | 2/2014 | Singh et al. | |
| 2015/0272249 | A1 | 10/2015 | Glenn | |
| 2016/0324225 | A1 | 11/2016 | Pollack et al. | |
| 2019/0223529 | A1 | 7/2019 | Park | |
| 2021/0007873 | A1 | 1/2021 | Frederick | |
| 2021/0137531 | A1 | 5/2021 | Rivero | |
| 2022/0095725 | A1 * | 3/2022 | Lynn | A41D 1/089 |

OTHER PUBLICATIONS

Communication (Written Opinion) issued by the International Searching Authority in International Application No. PCT/US2020/026181 dated Jul. 23, 2020, 5 pages total.

Supplementary European Search Report issued in European Patent Application No. 20 78 5363 dated Apr. 14, 2022.

* cited by examiner

FIGURE 6A
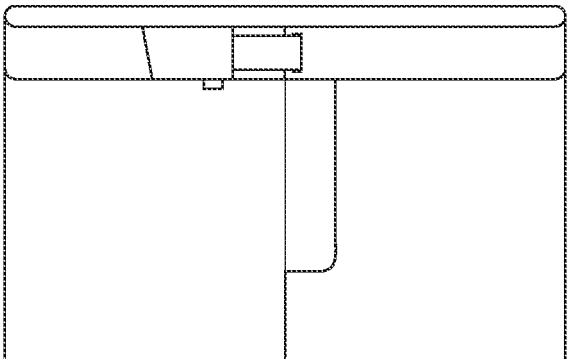
FIGURE 6B
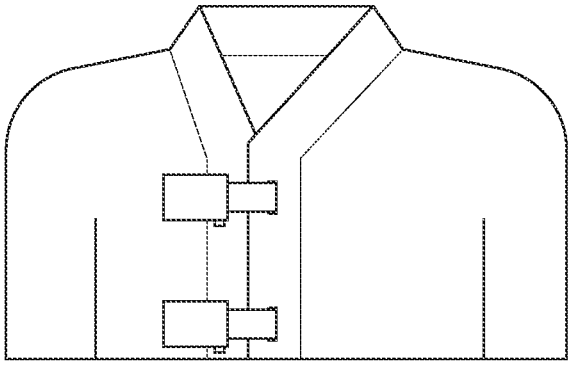
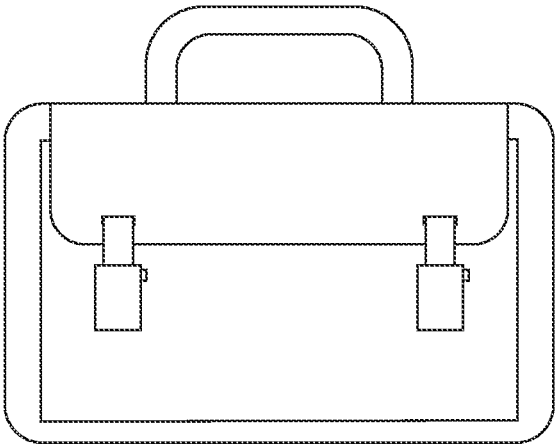
FIGURE 6C
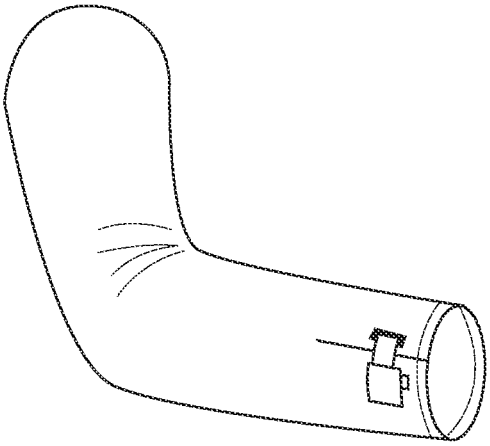
FIGURE 6D

INDEPENDENT DOUBLE-SIDED MATERIAL FASTENER

CROSS REFERENCE TO RELATED APPLICATIONS

This application is a Continuation of U.S. application Ser. No. 17/600,746, filed Oct. 1, 2021, which is a National Stage of International Application No. PCT/US2020/026181, filed Apr. 1, 2020 which claims priority to U.S. Provisional Application No. 62/828,016, filed Apr. 2, 2019, all of which are herein incorporated by reference in their entireties.

FIELD OF INVENTION

This invention is an improved adjustable non-irritating, low-profile material fastener with an integrated fit adjustment device and an independent secure double-sided seal, which maintains performance standards for athletic wear, most notably for watersports and surfing.

BACKGROUND

Waistband fasteners for shorts used during vigorous athletic activities, such as surfing and other watersports, tend to fall into two categories: Elastic waistbands and fixed waistbands. Elastic waistbands offer a range of fit adjustability, though frequently require an additional fastener for security during vigorous activity (typically via a drawstring). Fixed waistbands offer a narrower range of fit adjustability while being secured by their single fastener. The majority of both methods of construction feature a fastener on the centerline.

Surfers spend a lot of time balancing on the centerline and midpoint of their bodies (e.g. the waistline) as they paddle their boards. The friction between their bodies and the waistband fastener of their shorts can cause skin irritation and that same friction can agitate the fastener, causing it to fail or the friction can cause skin irritation.

A product that incorporates features of fit adjustability while addressing problems related to fastener failure and skin irritation would be a useful addition to the marketplace.

SUMMARY

Current watersport and surf shorts do not offer an integrated, independent double-sealed fastener that provides fit adjustability and minimizes irritation for the wearer. The majority of products available rely almost exclusively on centerline fasteners, which are proximate to the area of most contact and agitation between a paddling surfer and their board. The invention's proposed independent double-sided seal means two complementary and overlapping areas of hook and loop material fused onto either side of the fit-adjusting strap trap the strap onto the waistband. This combination makes the fastener highly resistant to failure.

The invention is an improved adjustable, non-irritating, low-profile material fastener with an integrated fit adjustment device and an independent secure double-sided seal that is offset from the wearer's centerline. One embodiment of the integrated tensioning device is a paper-thin rigid metal material embedded into the garment on one side of the waistband centerline. Another embodiment features the tensioning device attached to the exterior of the garment. A strap is affixed to the garment on the opposite side of the tensioning device. The strap crosses the centerline and passes through an aperture. The strap then reverses back upon itself, pulling against the integrated tensioning device to adjust the fit. The strap's tip, or billet, has loop material on both sides—the length of the loop material area is approximately 1.5 times the width of the strap. Once the strap is pulled against the tensioning device the loop material on the garment-facing side of the billet is affixed to hook material on the waistband. The length of hook material corresponds to the length of loop material on the billet, though perfect alignment between the hook and loop is not required to secure the strap's tip. Directly approximate to the waistband hook material area is a partially-attached flexible panel containing hook material on its underside. This panel is folded down, mating the hook material to the exposed loop material on the tip. As with the underside, perfect alignment is not required to secure the strap.

The resulting overlap of both hook and loop material sections on the inner and outer sides of the strap's tip form an independent double-sided seal for the fastener, located adjacent to the centerline of the wearer. The range of effective contact between the hook and loop material means fit adjustment can be achieved by repositioning the strap onto the waistband hook material area and covering the tip with the protective hinged material panel hook material.

Moving the fastener off of center removes it from the area with the most contact and agitation between the surfer and the board. This minimizes factors that contribute to irritation. The surfer's body applies pressure and agitation to both sides of the off-center fastener simultaneously, which can increase the security of the hook and loop material.

BRIEF DESCRIPTION OF DRAWINGS

The above and further aspects of this invention are further discussed with reference to the following description in conjunction with the accompanying drawings, in which like numerals indicate like structural elements and features in various figures. The drawings are not necessarily to scale, emphasis instead being placed upon illustrating principles of the invention. The figures depict one or more implementations of the inventive devices, by way of example only, not by way of limitation.

FIGS. 6A-6D illustrate a number of non-limiting uses for the fastener of the present invention.

DETAILED DESCRIPTION

The present invention related to an adjustable double sealed material fastener with an integrated tensioning device.

FIG. 1: is an illustrative representation of a sampling of garment waistbands and fasteners commonly known in the art and/or presently available in the marketplace. These tend to fall into two categories: those with openings (typically fixed waistband) and those without an opening (typically elastic waistband).

Waistbands with an opening tend to have fasteners that meet at the centerline. Some fasteners allow for a degree of fit adjustability, e.g. lace and eyelet fasteners. Other fasteners, e.g. button or snap fasteners, do not accommodate fit adjustability. As may be appreciated with eyelet and lace fasteners using a typical bowknot, the more tension used the greater the fastener security. Inserting slack into the lace can expand the fit, however, this slack can adversely affect the bowknot integrity, causing it to fail. Waistbands without an opening, e.g. elastic waistbands offer obvious fit adjustability though they do require an additional securing mechanism during vigorous watersport activity. This is typically provided by an interior eyelet and lace fastener.

Figure 1A:
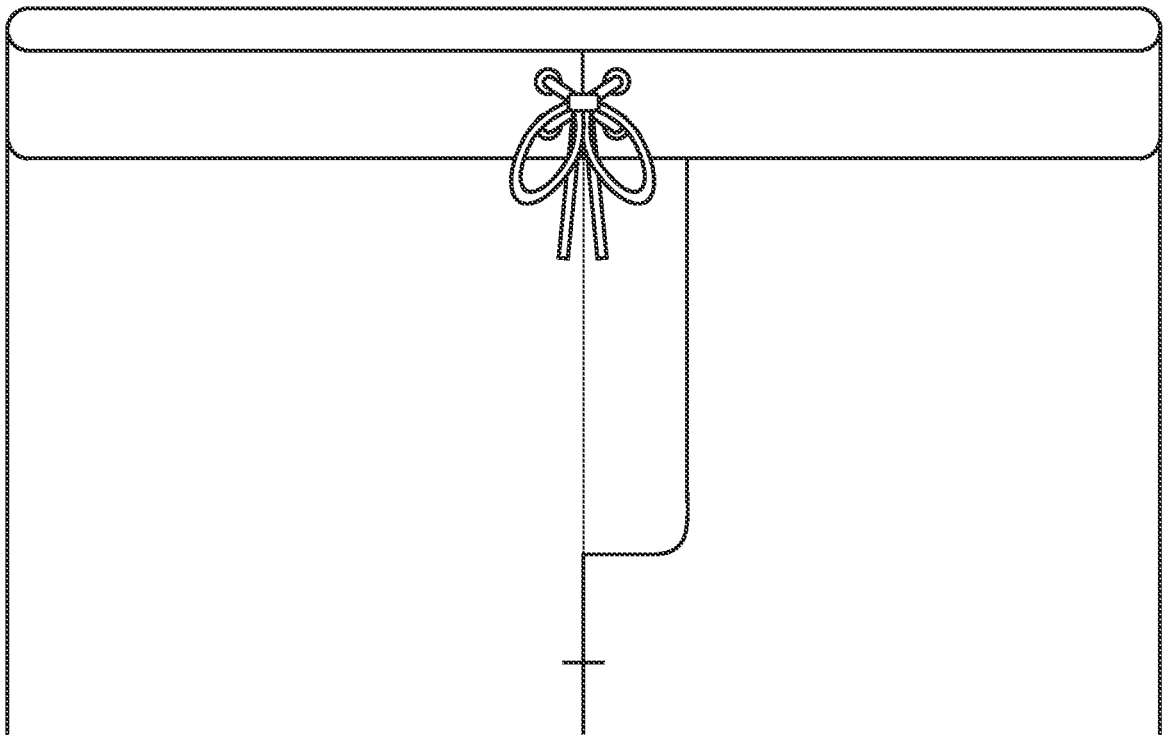
FIGURE 1A (Prior Art)
FIG. 1A illustrates a prior art lace and eyelet fastener waistband fasteners for watersports/surfing garments.

FIG. 1A: is an illustrative representation of a waistband fastener featuring a lace passing through a set of eyelets; the number of eyelets can vary.

Figure 1B:
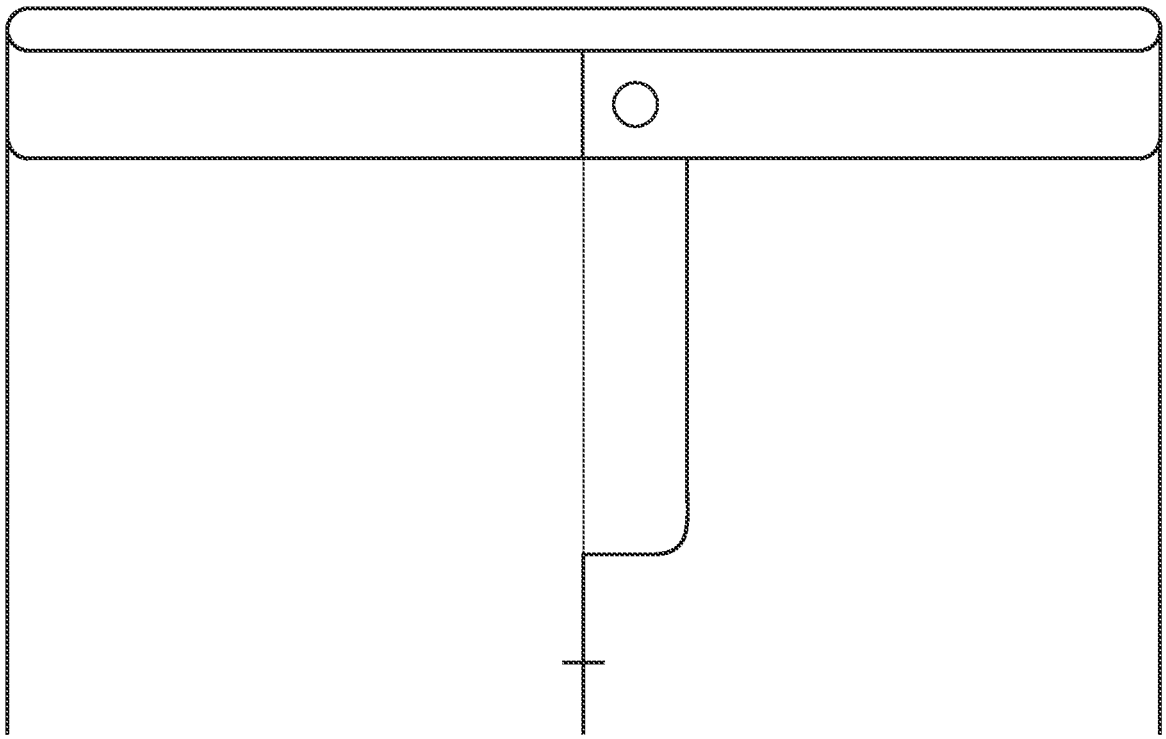
FIGURE 1B (Prior Art)
FIG. 1B illustrates a prior art button or snap fastener waistband fasteners for watersports/surfing garments.

FIG. 1B: is an illustrative representation of a button or snap fastener; the number of buttons or snaps can vary.

Figure 1C:
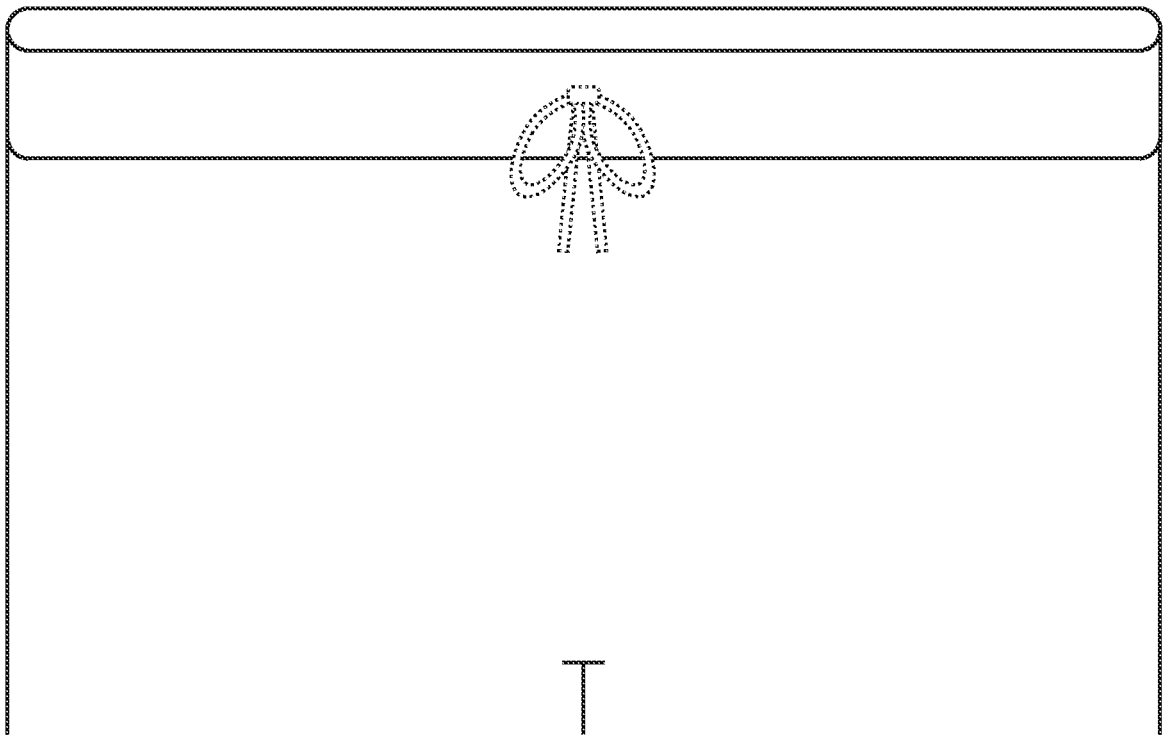
FIGURE 1C (Prior Art)
FIG. 1C illustrates a prior art elastic waistband with interior lace fastener without centerline opening waistband fasteners for watersports/surfing garments.
Figure 1D:
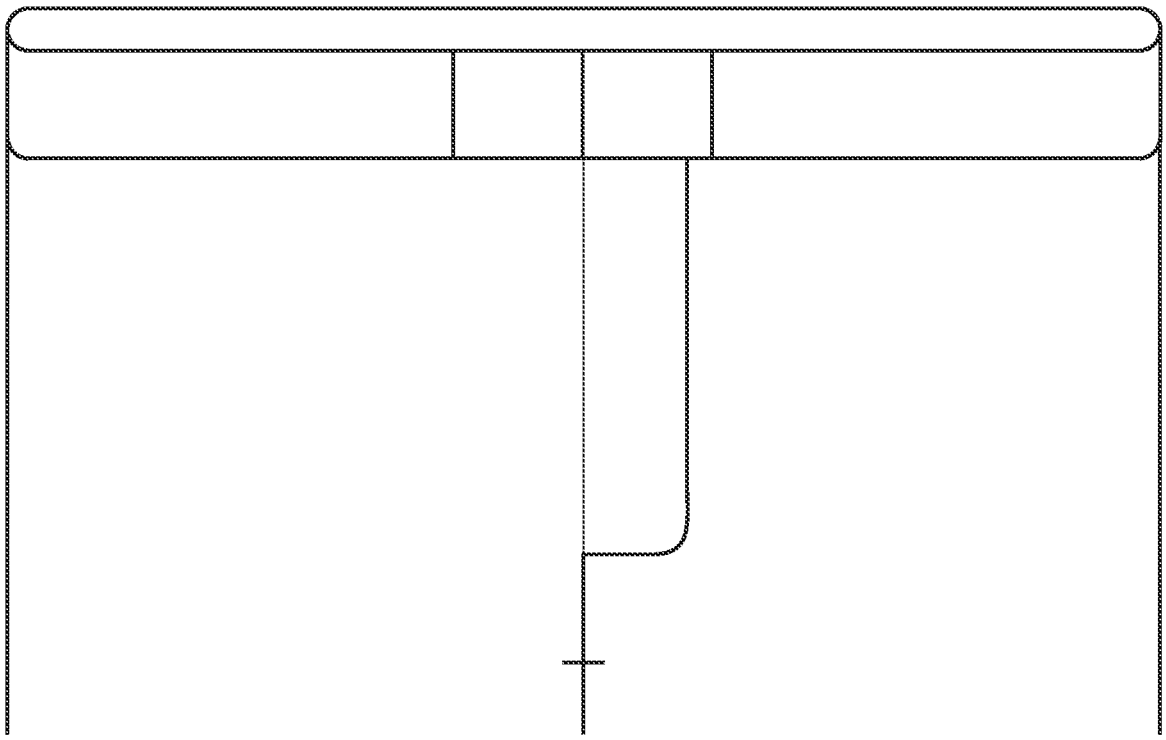
FIGURE 1D (Prior Art)
FIG. 1D illustrates a prior art double hook and loop fastener with overlapping panel waistband fasteners for watersports/surfing garments.

FIG. 1C: is an illustrative representation of an elastic waistband without an opening. FIG. 1D: is an illustrative representation of a double hook and loop waistband fastener.

Figure 2A:
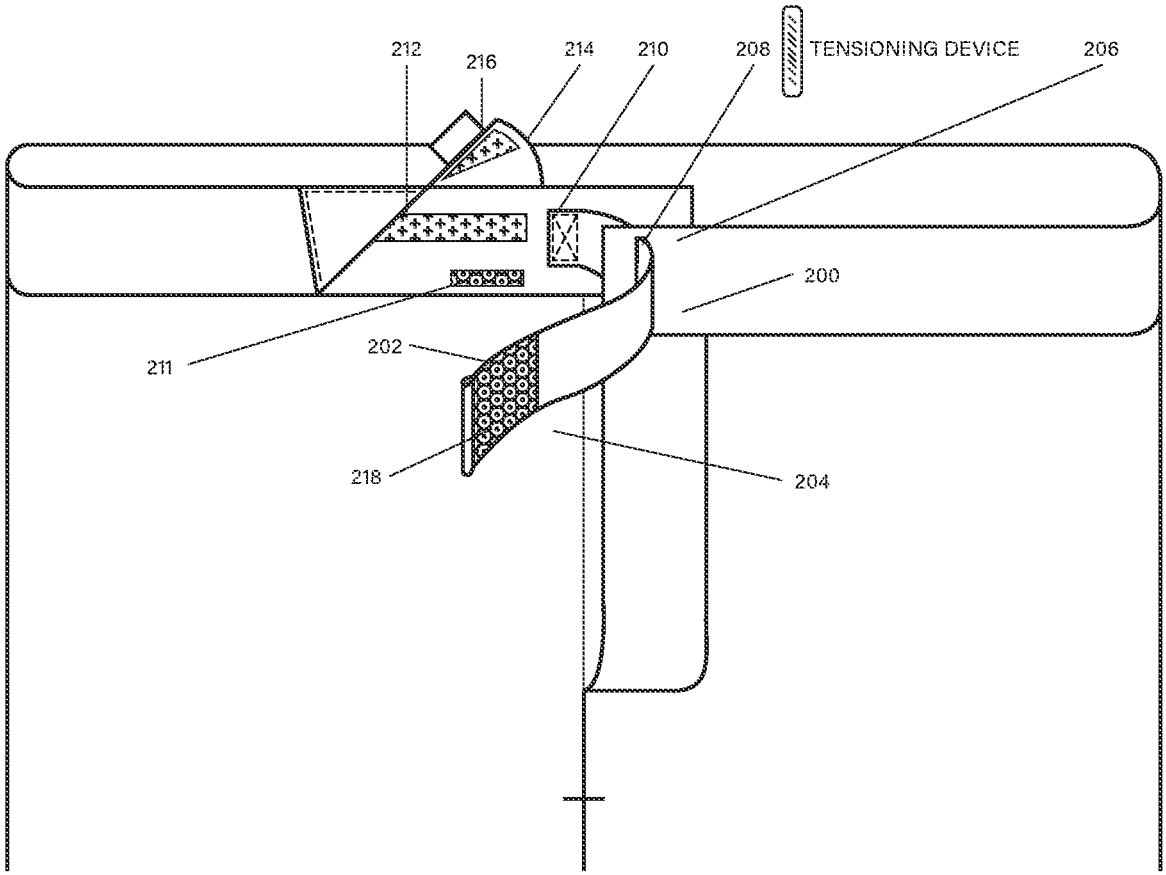
FIG. 2A illustrates an unfastened example of the present invention.

FIG. 2A: is an illustrative representation of a waistband fastener in accordance with the embodiments of the present invention. As illustrated, a waistband fastener embodiment may have a strap (200) with loop material on both sides of its tip (202 & 204). The strap may pass through an aperture (206), pull against an integrated tensioning device (208) to adjust fit. The strap may then affix to hook material on the garment waistband (210), said hook material positioned directly underneath a partially-attached flexible panel (212). Said partially-attached flexible panel features additional hook material (214) which is folded down onto the tip (204) to form a double-sided secure fastener. A small tab on the flexible panel (216) can be pulled up to expose the tip. A small area at the end of the tip (218) is free of hook and loop contact, and as such can be accessed to release the fastener.

Figure 2B:
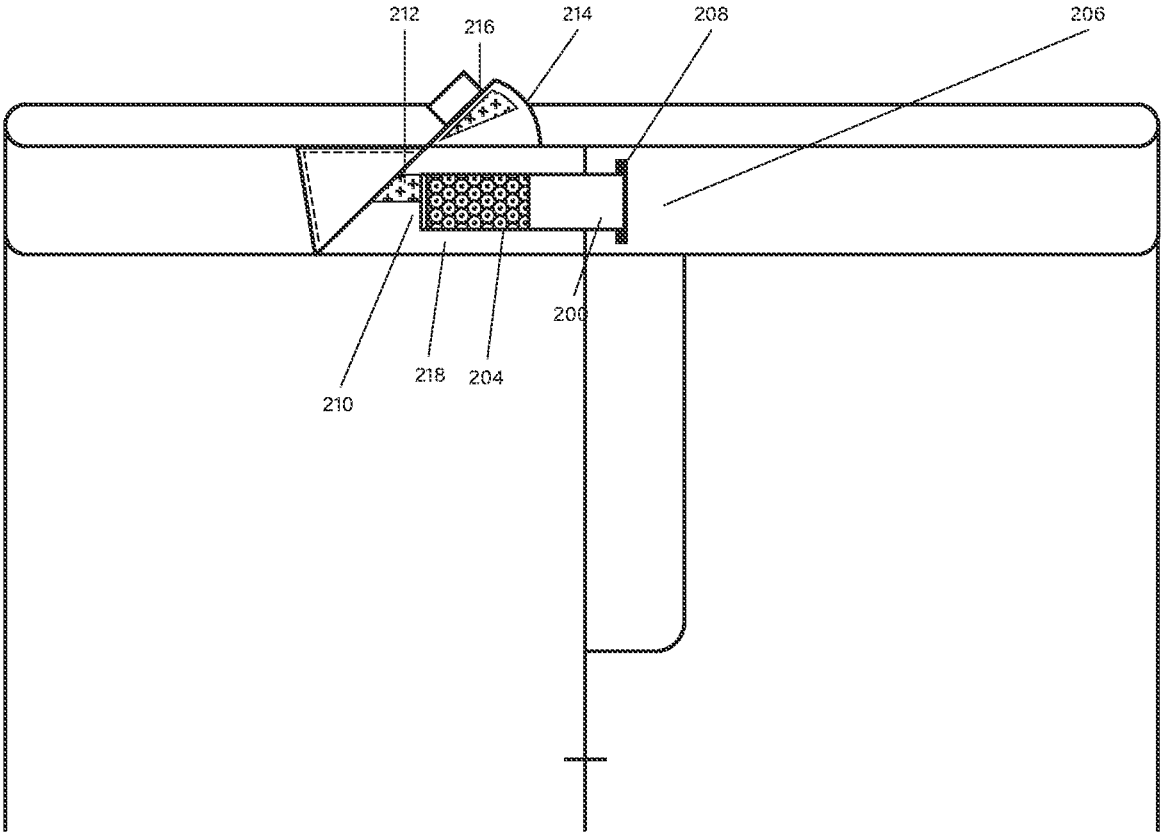
FIG. 2B illustrates a partially fastened example of the present invention.

FIG. 2B: is an illustrative representation of an embodiment of the present invention shown with the waistband partially secured. The strap (200) has passed through the aperture (206), pulled against the integrated tensioning device (208), and is partially locked into place by mating the inner tip loop material (202; not shown in this figure) with the waistband hook material (210).

Figures 2C, 2D:
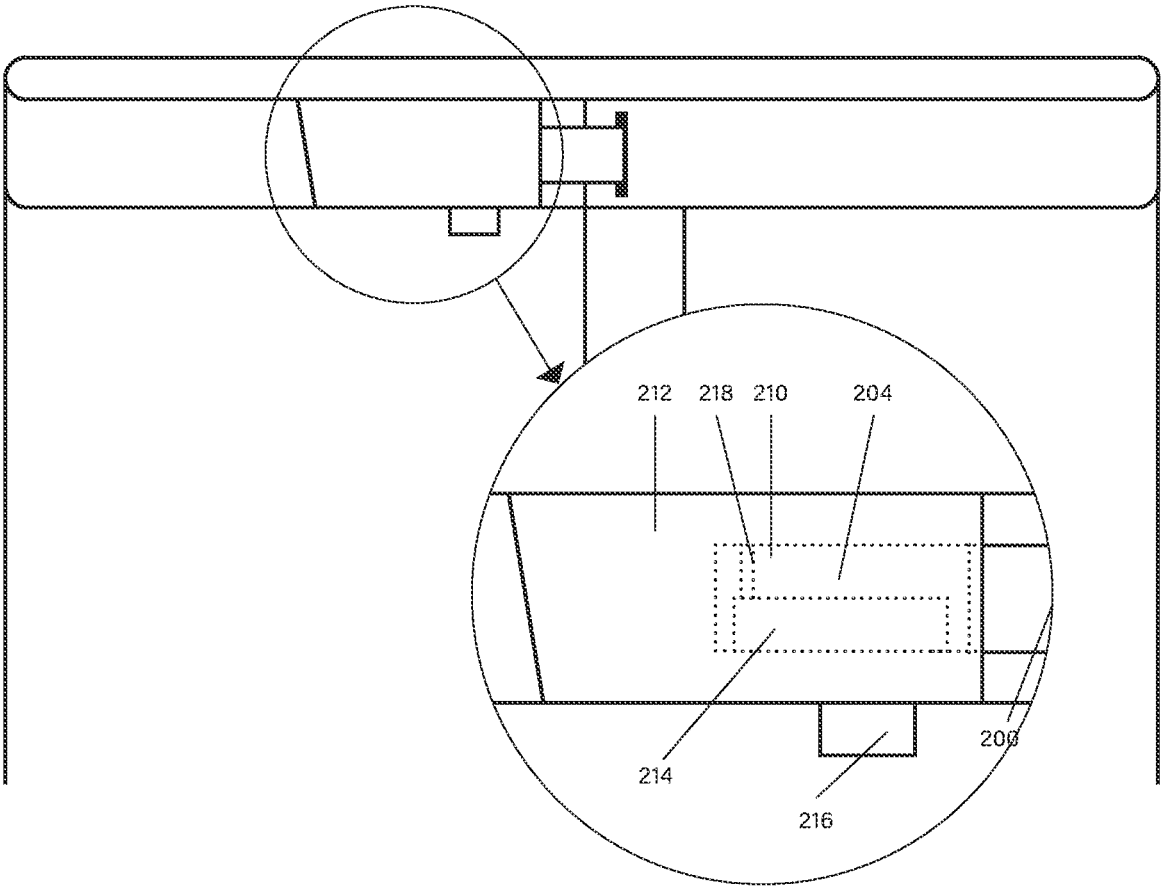
FIG. 2C illustrates a fully fastened example of the present invention.
FIG. 2D is a cut-away inset of FIG. 2C illustrating the fastened example.

FIG. 2C: is an illustrative representation of an embodiment of the present invention shown with the waistband fully secured. The partially-attached flexible panel (212) has been folded down, allowing the hook material on its underside (214) to mate with the outer tip's loop material (204).

Figure 3:
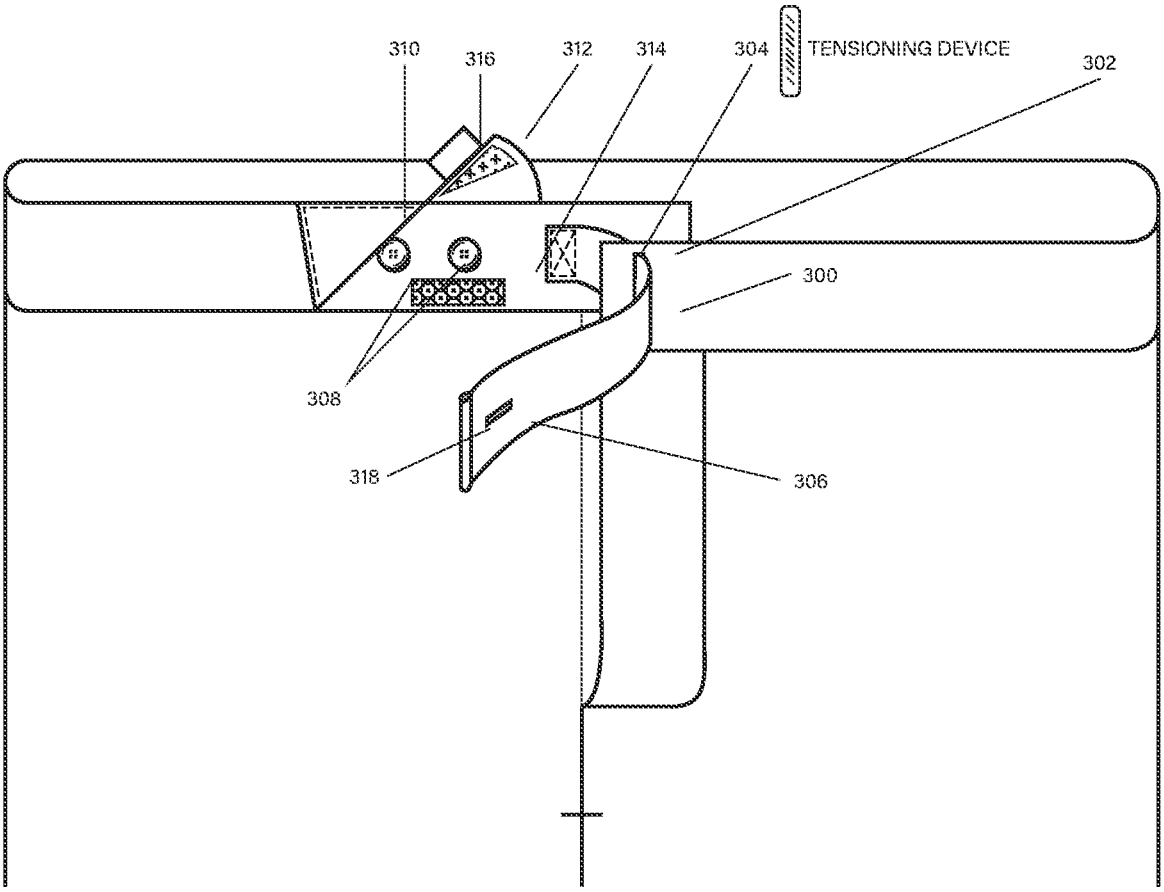
FIG. 3 illustrates another unfastened example of the present invention.

FIG. 3: is an illustrative representation of an alternative embodiment of the present invention. The strap (300) may pass through an aperture (302) and pull against an integrated tensioning device (304). The strap's buttonhole (306) may then attach to one of two buttons on the waistband (308). A flexible material panel (310) with hook material on its underside (312) may then fold down onto adjacent loop material located on the waistband (314). A small tab on the flexible panel (316) may be pulled up to expose the tip. A small area of the end of the tip (318) may be pulled to assist in releasing the strap from its attachment.

Figure 4:
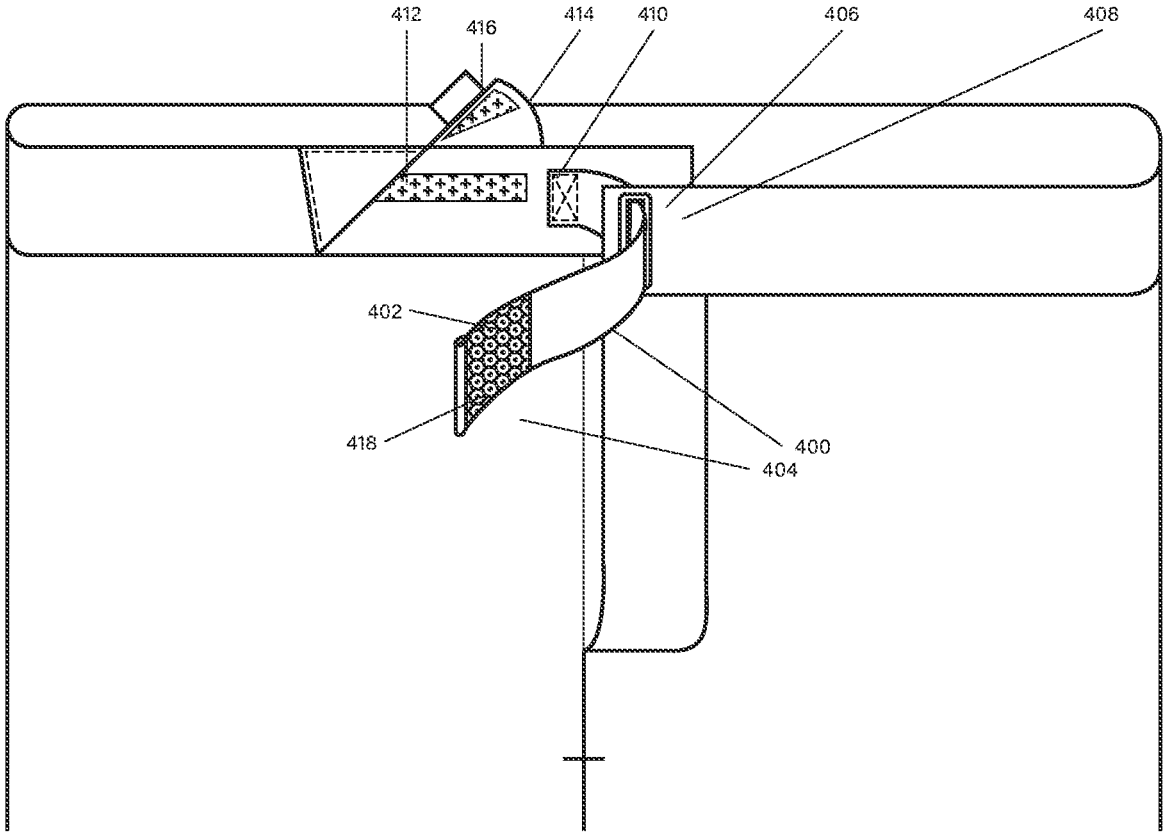
FIG. 4 illustrates a further unfastened example of the present invention.

FIG. 4: is an illustrative representation of an alternative embodiment of the present invention using an eyelet as a tensioning device. The strap (400) may pass through an aperture (406), pull against an integrated tensioning device (408) to adjust fit. The strap may then affix to hook material on the garment waistband (410), said hook material positioned directly underneath a partially-attached flexible panel (412). Said partially-attached flexible panel features additional hook material (414) on its underside which is folded down onto the tip to form a doubly-secured fastener. A small tab on the flexible panel (416) can be pulled up to expose the tip. A small area at the end of the tip (418) is free of hook and loop contact, and as such can be accessed to release the fastener.

Figure 5:
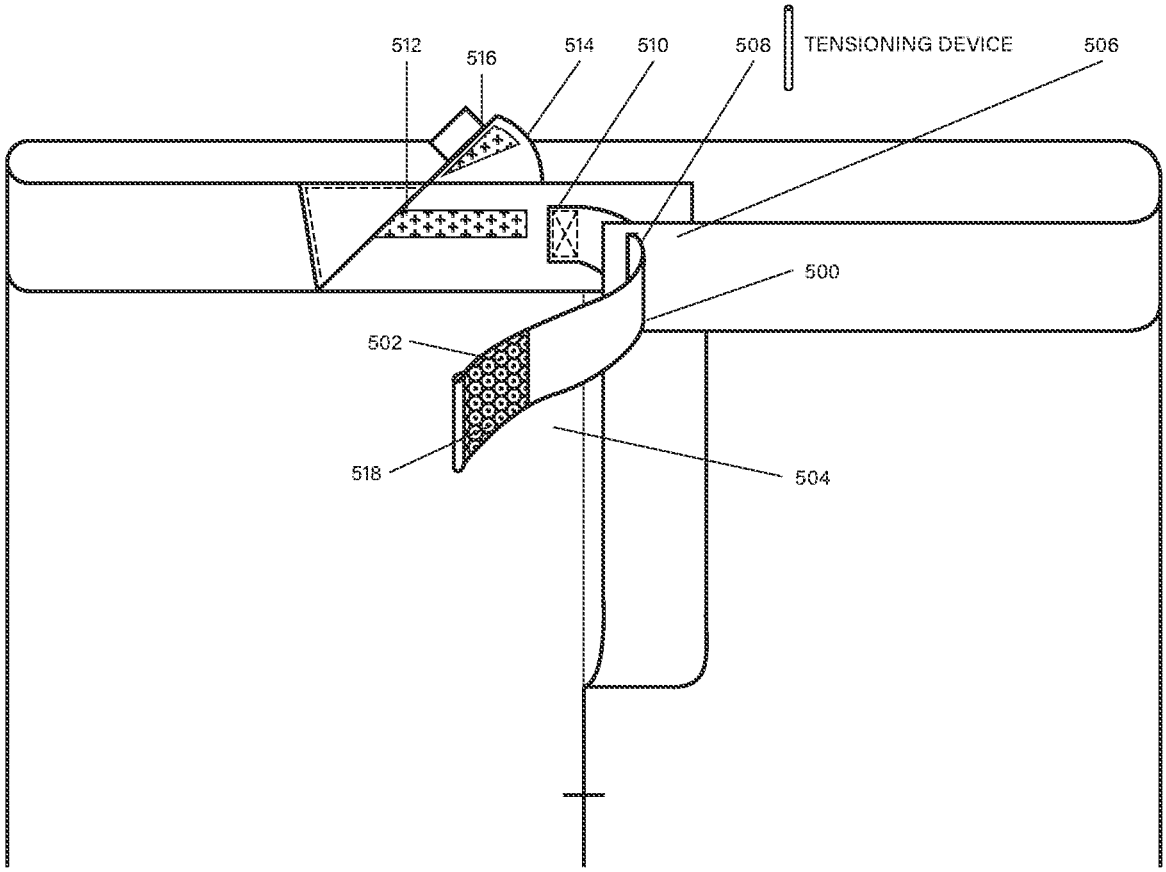
FIG. 5 illustrates yet another unfastened example of the present invention.

FIG. 5: is an illustrative representation of an alternative embodiment of the present invention using a rigid cylindrical tensioning device. The strap (500) may pass through an aperture (506), pull against an integrated tensioning device (508) to adjust fit. The strap may then affix to hook material on the garment waistband (510), said hook material positioned directly underneath a partially-attached flexible panel (512). Said partially-attached flexible panel features additional hook material (514) on its underside which is folded down onto the tip to form a doubly secured fastener. A small tab on the flexible panel (516) can be pulled up to expose the tip. A small area at the end of the tip (518) is free of hook and loop contact, and as such can be accessed to release the fastener.

FIG. 6: is an illustrative representation of alternative applications for the present invention. A material fastener can exist on multiple locations of a garment, such as the chest midline for a jacket or vest, and/or the hem area of a sleeve or pant cuff. Material fasteners also exist on items such as soft-sided luggage and/or camping gear.

Embodiments include having a strap which passes through an aperture, reverses direction to pull against an integrated tensioning device, and then mates with an independent double-sided seal with a partially-attached flexible protective fastener.

The invention claimed is:

1. A fastener connecting two materials, comprising:

a first material comprising a strap aperture; and a second material comprising a second material affixing mechanism;

a strap extending toward the strap aperture, the strap comprising:

a top side comprising a top side affixing mechanism; and a bottom side, opposite the top side, comprising a bottom side affixing mechanism;

a hinged material panel disposed proximate the second material affixing mechanism comprising a hinged panel affixing mechanism, wherein the strap is configured to a fastened position comprising:

pass through the strap aperture;

reverse the strap back upon itself;

affix the bottom side affixing mechanism to the second material affixing mechanism; and affix the top side affixing mechanism to the hinged panel affixing mechanism; and wherein the strap is interposed between both the second material affixing mechanism and the hinged panel affixing mechanism resulting in a secure, protected independent double-sided material fastener which can be engaged and disengaged repeatedly and adjusted.

2. The fastener of claim 1, further comprising:

a tab disposed from the hinged material panel opposite a hinge of the hinged material panel, wherein pulling the tab disengages the hinged panel affixing mechanism from the top side affixing mechanism.

3. The fastener of claim 1, wherein the first material further comprises a tensioning element adjacent the strap aperture that is tensioned against the strap when the strap is reversed back upon itself.

4. The fastener of claim 3, wherein the tensioning element partially surrounds the strap aperture.

5. The fastener of claim 1, wherein the first and the second materials are part of the same item and separated by an opening.

6. The fastener of claim 1, wherein the first and the second materials are opposite ends of the same material.

7. The fastener of claim 6, wherein the first and the second materials are separated by an opening.

8. The fastener of claim 1, wherein the first and the second materials are part of a bag.

9. The fastener of claim 1, wherein at least one of the hinged panel affixing mechanism, the second material affixing mechanism, the bottom side affixing mechanism, and the top side affixing mechanism comprise a hook-and-loop material.

10. The fastener of claim 1, wherein the second material affixing mechanism comprises a button.

11. The fastener of claim 1, wherein the strap is connected to the second material at a point of attachment and the strap reverses back past the point of attachment.

12. A fastener connecting two materials, comprising:

a first material comprising a strap aperture;

a second material comprising:

a strap connected to a point of attachment on the second material, the strap comprising:

a top side comprising a top side affixing mechanism; and a bottom side, opposite the top side, comprising a bottom side affixing mechanism;

a second material affixing mechanism on the second material disposed to a side of the point of attachment;

a hinged material panel disposed proximate the second material affixing mechanism comprising a hinged panel affixing mechanism; and wherein the fastener comprises a fastened position when the strap is configured to:

pass through the strap aperture;

reverse the strap back upon itself and pass the point of attachment;

affix the bottom side affixing mechanism to the second material affixing mechanism; and affix the top side affixing mechanism to the hinged panel affixing mechanism; and wherein the strap is interposed between both the second material affixing mechanism and the hinged panel affixing mechanism resulting in a secure, protected independent double-sided material closure which can be engaged and disengaged repeatedly and adjusted.

13. The fastener of claim 12, further comprising:

a tab disposed from the hinged material panel opposite a hinge of the hinged material panel, wherein pulling the tab disengages the hinged panel affixing mechanism from the top side affixing mechanism.

14. The fastener of claim 12, wherein the first material further comprises a tensioning element adjacent the strap aperture that is tensioned against the strap when the strap is reversed back upon itself.

15. The fastener of claim 12, wherein the first and the second materials are part of the same item and separated by an opening.

16. The fastener of claim 12, wherein the first and the second materials are opposite ends of the same material and separated by an opening.

17. The fastener of claim 12, wherein at least one of the hinged panel affixing mechanism, the second material affixing mechanism, the bottom side affixing mechanism, and the top side affixing mechanism comprise a hook-and-loop material.

* * * * *